US005180947A

United States Patent [19]

McGill

[11] Patent Number: 5,180,947

[45] Date of Patent: Jan. 19, 1993

[54] SHIELDED CATHODE RAY TUBE

[75] Inventor: Terrence M. McGill, Stevensville, Md.

[73] Assignee: Alliant Techsystems Inc., Edina, Minn.

[21] Appl. No.: 689,966

[22] Filed: Apr. 23, 1991

[51] Int. Cl.[5] ..... H01J 1/52

[52] U.S. Cl. ..... 315/85; 315/8; 313/402; 313/479

[58] Field of Search ..... 315/8, 85; 313/479, 313/402, 477 R; 361/150; 358/245

[56] References Cited

U.S. PATENT DOCUMENTS

| | | | |
|---|---|---|---|
| 3,867,668 | 2/1975 | Shrader | 315/8 |
| 4,467,241 | 8/1984 | Hines | 313/479 X |
| 4,517,487 | 5/1985 | Tamburrino | 313/407 |
| 4,556,821 | 12/1985 | Cooper | 315/85 X |
| 4,767,969 | 8/1988 | Green | 315/85 |

FOREIGN PATENT DOCUMENTS

| | | | |
|---|---|---|---|
| 0108156 | 8/1980 | Japan | 313/479 |

OTHER PUBLICATIONS

Service Manual for Sony Trinitron ® Graphic Display Monitor GDM-1950/1952.

*Primary Examiner*—Eugene R. LaRoche
*Assistant Examiner*—Son Dinh
*Attorney, Agent, or Firm*—Merchant, Gould, Smith, Edell, Welter & Schmidt

[57] ABSTRACT

A shielded CRT (18) display includes a secondary shielding enclosure (14) for enclosing the CRT (18) and for inhibiting electromagnetic emissions therefrom. A primary shielded enclosure (12) internal to the secondary shielding enclosure (14) has a portion coaxial (16) with the neck portion (22) of the CRT (18) for also inhibiting electromagnetic emissions from the CRT (18). The CRT (18) includes an internal conductive layer comprised of an internal aquadag, wire mask, and phosphor coating. This internal conductive layer is grounded via a reactive path to ground to suppress electromagnetic emissions. This double shielding suppression technique eliminates the need for external shielding of the face portion of the CRT (18).

28 Claims, 4 Drawing Sheets

SHIELDED CATHODE RAY TUBE

FIELD OF THE INVENTION

The present invention generally relates to the inhibition of electromagnetic emissions from a cathode ray tube (CRT). More particularly, the present invention relates to a shielded cathode ray tube for inhibiting radio frequency (RF) emissions from a cathode ray tube display without the use of external face shielding.

BACKGROUND OF THE INVENTION

The aperture required for a CRT display in the wall of a shielded enclosure containing electromagnetic generating components creates a potential shielding deficiency. Electromagnetic energy generated by the components may be transmitted through the aperture with relatively minor attenuation. The conventional approach used for attenuating emissions through the aperture is an optically transparent conducting screen in the form of either a wire mesh or a thin homogenous layer, for example indium tin oxide or metallic gold. The conducting screen covers the external face of the CRT and is bonded along the entire periphery of the aperture, thus providing a shielding enclosure completely enclosing the emission generating components.

The use of external screens causes a degradation in pixel pitch, resolution and the brightness of the CRT display. In addition, the formation of "noise" patterns occurs as a consequence of interaction of the geometric periodicity of the wire mesh and the dot matrix CRT phosphor geometry. These problems are pronounced in high resolution color monitors. The use of homogeneous conductive films significantly reduces optical transparency at thicknesses required to provide adequate shielding. The utilization of either a wire mesh or a thin homogeneous layer requires electrical bonding to the conductive monitor enclosure which is expensive and often increases the weight and physical size of the CRT display. In addition, the appearance and operational ergonomics of the monitor are degraded. As optical resolution and video bandwidths increase, the limitation of external shielding of a color CRT display becomes more evident.

One approach utilized to inhibit electromagnetic emissions through the aperture and face of the CRT display without the use of external conducting screens is disclosed U.S. Pat. No. 4,767,969, entitled RF EMISSION SHIELD FOR CRT DISPLAYS, issued Aug. 30, 1988 to Green and assigned to Honeywell, Inc. Disclosed therein is a shield placed at the neck of a CRT envelope which inhibits the RF emissions from being transmitted through the aperture and face of the CRT display. The shield comprises longitudinal conductors and circular conductors for suppressing emissions from the CRT.

Although a single shield method, such as that disclosed in U.S. Pat. No. 4,767,969, reduces the electromagnetic emissions through the CRT display face, further suppression techniques to meet compliance levels without the use of external screens are needed.

SUMMARY OF THE INVENTION

The shielded CRT of the present invention includes a CRT having an internal conductive layer associated with a display face of the CRT. A shielded enclosure encloses the CRT and has an aperture through which the display face of the CRT extends. The internal conductive layer of the CRT is grounded by way of a reactive path to ground.

According to another aspect of the invention, the conductive layer of the CRT is connected to an anode signal line, the anode signal line connected to ground via an anode filter for the signal line.

According to yet another aspect of the invention, the shielded CRT includes a CRT having a neck portion and a non-shielded display face. Secondary shielding encloses the cathode ray tube and inhibits electromagnetic emissions therefrom. The display face of the CRT extends through an aperture of the secondary shielding. Primary shielding internal to said secondary shielding has a portion thereof coaxial with the neck portion of the CRT. This configuration suppresses electromagnetic emissions through the display face and the aperture of the secondary shielding without the need for external face shielding.

In a further embodiment of the present invention the primary shielding includes a shielded enclosure surrounding video circuitry connected to the CRT and a portion coaxial with the neck portion. The portion coaxial with the neck portion includes a cylindrical continuous conductor waveguide. The waveguide may include a plurality of separated longitudinal conductor fingers positioned within the cylindrical waveguide as a function of the position of the CRT's divergence and deflection coils. The conductor waveguide is operated below cutoff for frequencies of less than 2 Ghz to provide RF suppression.

BRIEF DESCRIPTION OF THE DRAWINGS

In the drawings, in which like reference numerals indicate corresponding parts of the preferred embodiment of the present invention throughout the several views.

DETAILED DESCRIPTION OF THE PREFERRED EMBODIMENT

In the following detailed description of the preferred embodiment, references are made to figures which form a part hereof and in which the invention may be practiced. This embodiment is described in sufficient detail for those skilled in the art to practice the invention and it is to be understood that other embodiments may be utilized without departing from the spirit and scope of the present invention. The following detailed description is therefore not to be taken in a limiting sense and the scope of the present invention is defined by the appended claims.

Figure 1:
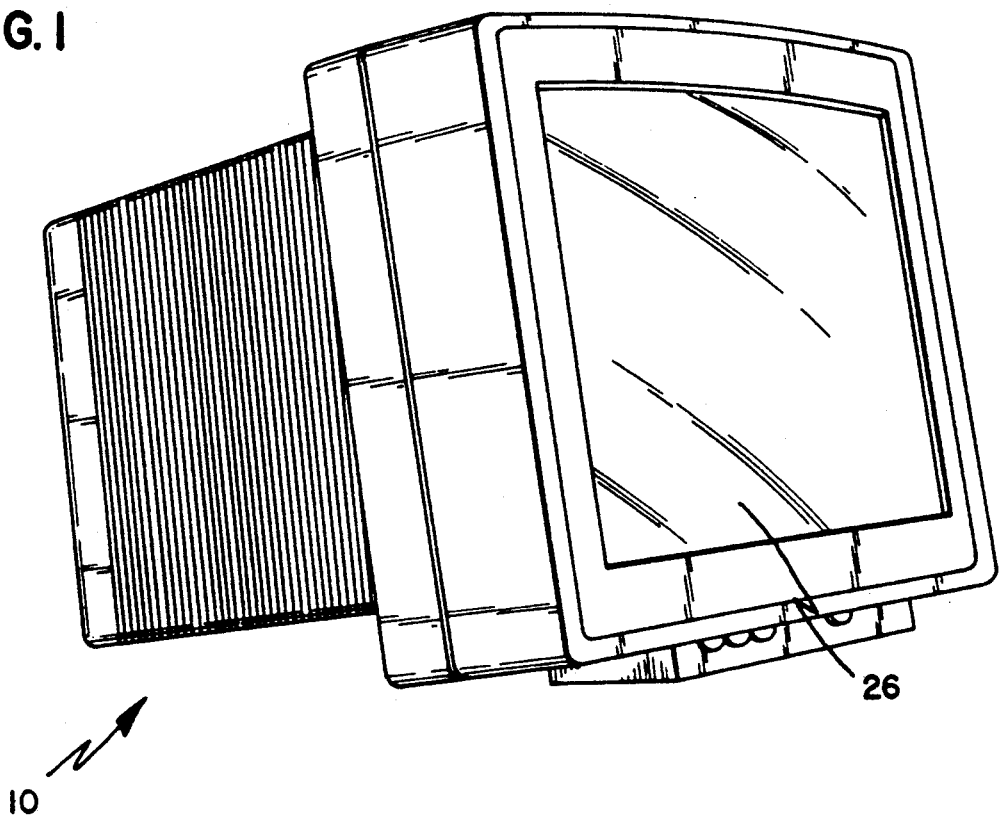
FIG. 1 is a perspective view of the shielded CRT display.

Referring now to FIGS. 1-9, the preferred embodiment of the shielded CRT display or monitor 10 of the present invention will be described. FIG. 1 shows a perspective view of the shielded CRT display. Preferably, this is a Sony model 1950 high resolution color monitor, further described in Sony® Trinitrom® Graphic Display Monitor GDM-1950/1952 Service Manual which is hereby incorporated herein by reference, modified with suppression techniques for inhibiting electromagnetic emissions therefrom.

Figure 2:
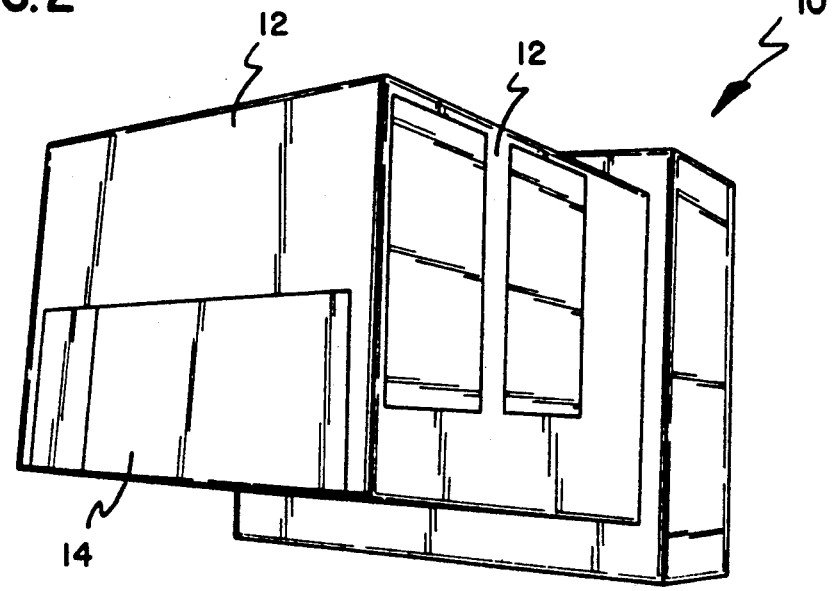
FIG. 2 is a rear perspective view of the CRT display of FIG. 1 with portions thereof cut away to show details.
Figure 3:
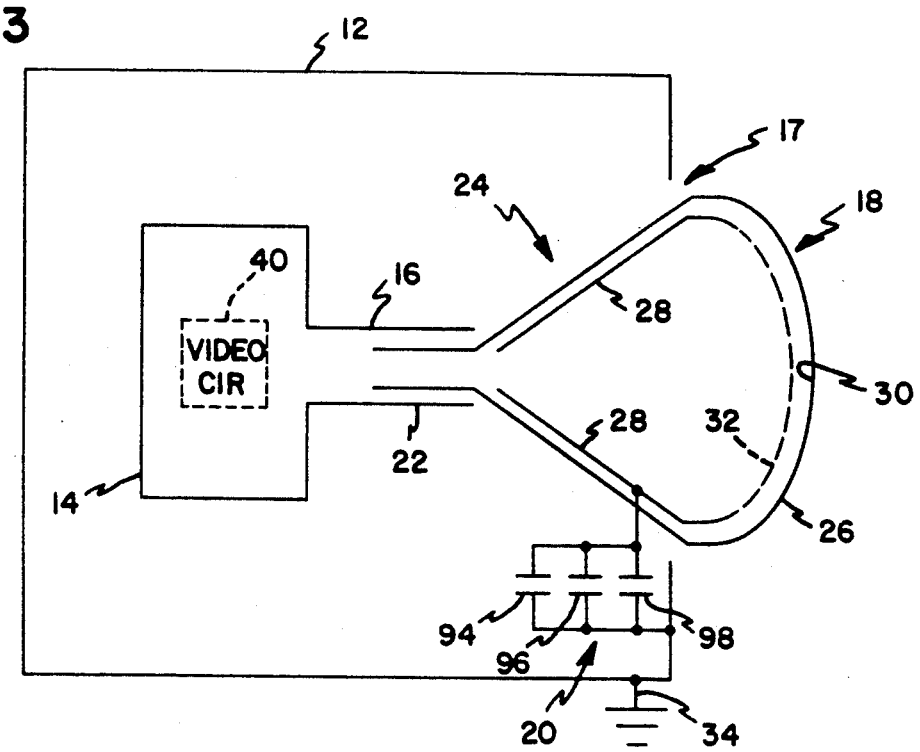
FIG. 3 is a simple schematic of the shielded CRT display configuration.

The CRT display 10 includes a display face 26, FIG. 1, and a primary enclosure 14 and secondary enclosure 12 as shown in FIG. 2. The shielded CRT display is shown schematically by FIGS. 3 and 4. The shielded CRT display 10 utilizes double shielding suppression to eliminate the need for additional external shielding of the display face 26. The CRT display 10 includes a CRT 18 having a neck portion 22 coupled to display face 26 via CRT envelope 24. A first level of shielding is accomplished by primary shielded enclosure 14, similar to that disclosed in U.S. Pat. No. 4,767,969, the disclosure of which is hereby incorporated herein by reference. Primary enclosure 14 encloses video amplifier circuitry 40 and includes a waveguide neck shield 16 positioned coaxially with neck portion 22 of CRT 18. This neck shield is a cylindrical conducting surface that acts as a waveguide operated below cutoff for frequencies less than 2 GHz. Transmission of energy at frequencies associated with video waveforms is highly attenuated with the waveguide, thus limiting the radiation from the primary enclosure at these frequencies.

The second level of the double shielding suppression technique utilizes a secondary shielding enclosure 12 surrounding the primary enclosure 14 and CRT 18. CRT display face 26 extends through an aperture 17 in secondary enclosure 12. The conductive aquadag 28, conductive pixel mask 32, and conductive phosphor coating 30, all internal to CRT 18 along the inner surface of CRT envelope 24, are coupled via a second anode filter 20 to chassis ground 34 to complete a secondary conducting envelope surrounding potential radiators of electromagnetic emissions. In particular, the secondary shielding inhibits emanations which radiate from the tunnel and grid assemblies not inhibited by the primary shielding means. This double shielding suppression technique eliminates the need for an additional external optically transparent conducting screen for the CRT display face 26. Eliminating the need for external shielding of the display face improves the optical resolution of the display. In addition, the associated material cost and labor involved in the delicate electrical bonding operation of the external conducting screen to the conductive display enclosure are avoided. This "inverted topology", moves the radiation barrier from its conventional location, in front of the CRT face, to behind the CRT face. It should be readily apparent that either of these shielding techniques can be used separately, except the effectiveness of suppression of emissions will be reduced.

The details concerning the modification of the Sony model 1950 high resolution color monitor will now be described with reference to FIGS. 1-9. Color monitors all employ internal screens (or in the case of Sony, wire masks) to provide separation of the three color electron beams therein. The present invention utilizes the internal screens or wire masks and associated internal conductive elements of the color CRT to provide enhanced suppression of RF emissions from the CRT display. Although this invention is described with reference to a color CRT display, the present invention can be utilized with any CRT display with appropriate modifications.

The modifications and enhancements, described with reference to Sony model 1950 color monitor, which reduce emanation of RF emissions without the use of external screens or homogeneous conductive films are also equally applicable to other color displays, including but not limited to Sony model 1900 and 1600 series color monitors and Mitsubishi 1400 series high resolution color monitors. Although the circuitry of the color monitors does vary, many have similar internal CRT cathode, anode and grid structures. The circuits that process the video signals are often located near the CRT neck and can be isolated through shielding, cable routing, grounding, waveguides and filtering as shall be discussed further below.

Figure 4:
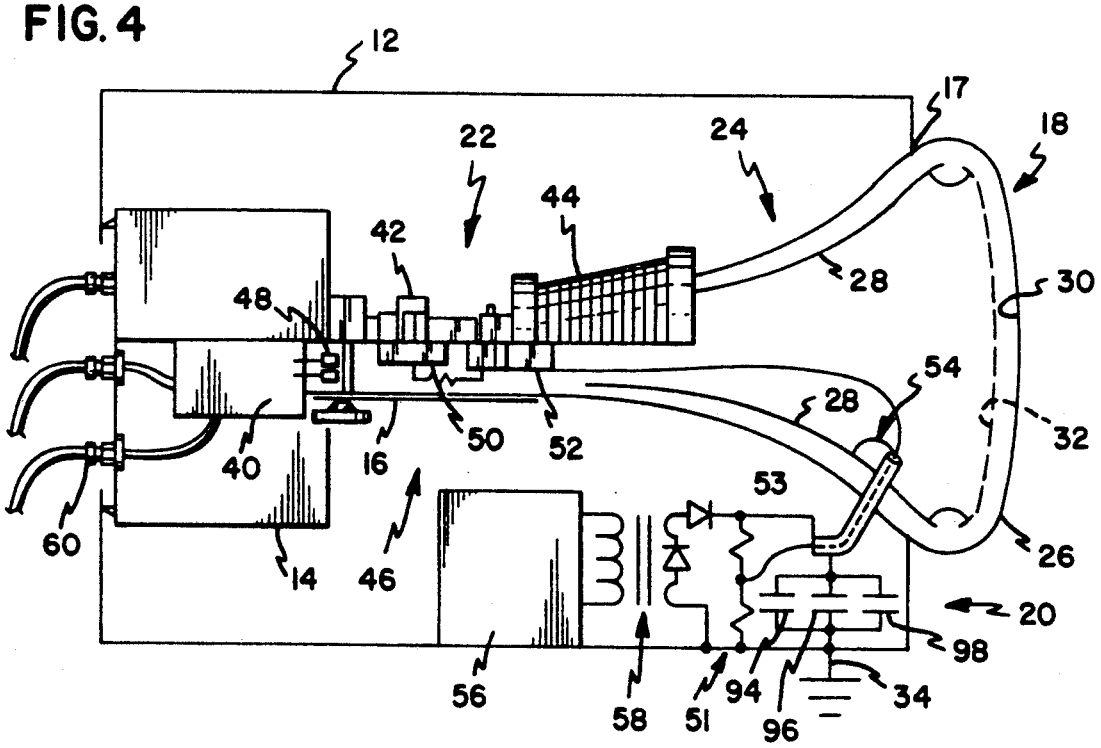
FIG. 4 is a more detailed schematic of the shielded CRT display configuration.

The preferred embodiment is best described with reference to FIG. 4. Primary enclosure 14 surrounds the video amplifier circuitry 40 associated with CRT 18. External signals are applied via shielded cables through double shielded cable connections 60 to video amplifier circuitry 40, which in turn applies signals to cathodes 48.

Figure 6:
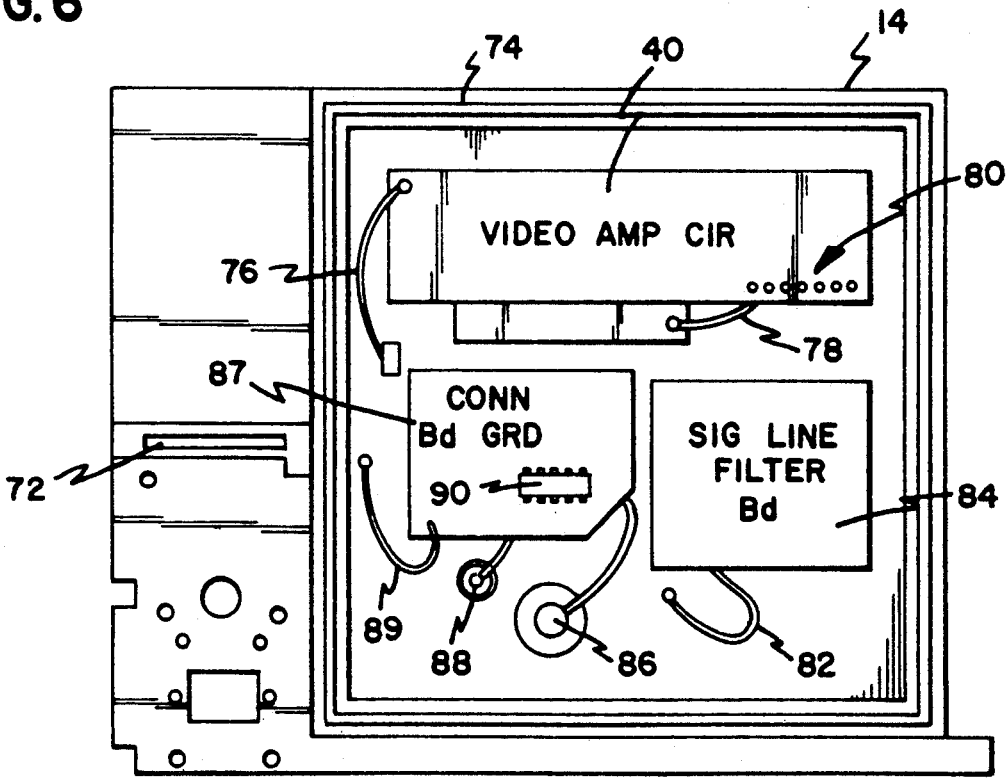
FIG. 6 is a rear view of the CRT display of FIG. 1 with portions of the primary shield cut away to show detail.

Modifications to portions of the primary enclosure are shown in FIG. 6. The cover gasket 74 around the periphery of the primary enclosure 14 and gasket 72 provide low impedance bonding between a cover (removed in FIG. 6) and portions of the secondary enclosure 12 to create a continuous conductive enclosure. CRT connector board 87 is grounded to primary enclosure 14 via a low inductance braid 89 and ground gasket 90. The signal line filter board 84 and ground strap 82 also provide grounding for various elements within the primary enclosure 14. Video cables 76 apply signals to the video amplifier circuitry 40. The video amplifier of video circuitry 40 is grounded by a ground strap 78 and further protected by six decoupling capacitors 80. The signal line filter board 84 is enhanced through the use of filter elements including a 15 pin feedthrough filter adaptor, various inductors and capacitors, a ground lug and a D connector cable.

The CRT intensity signal line of the CRT is filtered by filter 88 which is an axial feedthrough filter. The first anode dynamic focus signal line is filtered by a special high voltage feedthrough filter assembly 86 which includes a SAC-designed arc shield, a 2500 pf, 10 KV capacitor and a shielded high voltage lead 68 with a solder lug connector.

The interface cable 64 and connector 85 connects a wave shaping circuit (not shown) inside the primary enclosure 14 with deflection board 70, power board 77 and front panel controls (not shown) in the secondary enclosure. The cable has been attached to the original equipment leads and mounted as required to minimize cross coupling and cable radiation.

The video circuitry 40 applies signals to cathodes 48 in the neck portion 22 of CRT 18. As is readily known, the electrons from the cathodes 48 are accelerated and directed towards the display face via the tunnel and grid structure 46 including divergence coils 42, focus and first anode 50, convergence grid 52, deflection coils 44 and second anode 54. The CRT includes a conductive layer comprised of a pixel mask 32 and conductive phosphor coating 30 coupled to conductive aquadag 28 by finger stock 31. Anode potentials applied via the respective anode signal lines are filtered by a first anode dynamic focus filter 86 connected to the signal line applying potential to the first anode. The second anode filter 20 is connected to the signal line applying potentials to the second anode. These high potentials applied via a coaxial signal line for the second anode are generated by horizontal amplifier 56, flyback transformer 58 and high voltage rectifier 51.

The waveguide neck shield 16 is electrically bonded to the portion of the primary enclosure 14 surrounding the video circuitry 40 such that it is coaxial with the neck portion 22 of CRT 18. The portion of primary enclosure 14 surrounding the video circuitry as well as secondary enclosure 12 are constructed substantially of aluminum. The waveguide is a continuous conductor constructed of beryllium copper of 0.006 inch thickness, and having dimensions of 4.540 inches by 3.750 inches. The material has properties according to ASTM spec B-194. The cylindrical waveguide surrounds the tunnel and grid structure 46 which includes cathodes 48, such that electromagnetic emissions at frequencies below 2 GHz would be highly attenuated. The cylindrical waveguide 16 is located between the divergence coils 42 and the anode/cathode structures of the CRT neck portion 22 and extends at least one and one-half inch beyond cathodes 48.

Figure 9:
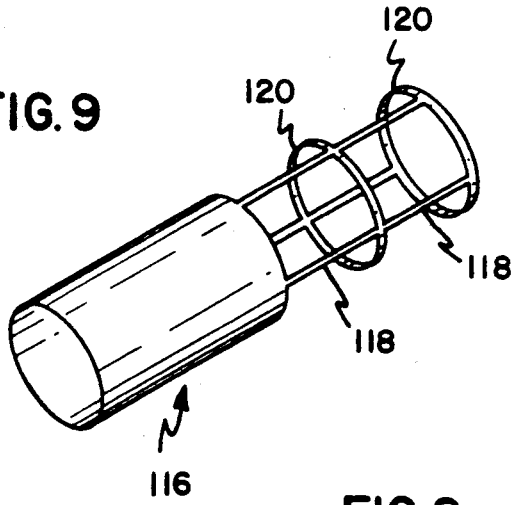
FIG. 9 is a perspective view of another alternative embodiment of the waveguide neck shield for use in the shielded CRT display of present invention.
Figure 8:
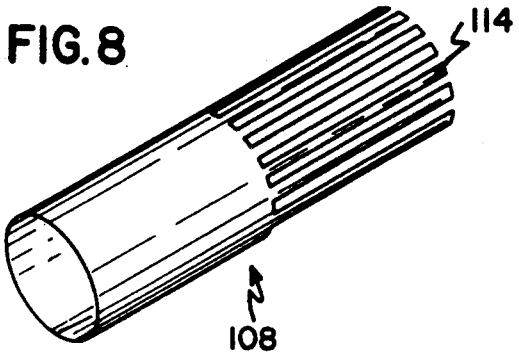
FIG. 8 is a perspective view of an alternative embodiment of the waveguide neck shield utilized in the shielded CRT display of the present invention.

The interposition of the CRT waveguide neck shield 16 in the vicinity of the beam divergence coils 42 and deflection coils 44 can pose a problem in short neck monitor tubes if the waveguide wall is constructed of a continuous, isotropic conductor as described above. The waveguide neck shield would act effectively to shield the electron beam from the deflection field itself. Moreover, such a shield would behave as a shorted-turn secondary winding on a transformer whose primary windings are the divergence and/or deflection coils. To prevent this occurrence, modified waveguides shown in FIGS. 8 and 9 are utilized in short neck CRT applications. The waveguide neck shield 16 is modified in the vicinity of these coils to prevent this occurrence.

Modified waveguide neck shield, 108, FIG. 8, includes slots 114 in the divergence coil 42 and deflection coil 44 vicinities. As an alternative modified neck shield 116, FIG. 9, a set of fingers 118, extending longitudinally, connected to rings 120 coaxial with the neck portion 22 would be positioned with respect to the divergence coil 42 and/or deflection coils 44. In addition, the use of modified neck shields in the vicinity of the divergence and deflection coils would eliminate heat problems created by induced circulation currents.

The EMI filter assemblies used in connection with the anode signal lines for the first anode 50 and second anode 54 effectively filter the signal lines. Typically, commercially available EMI filters use feedthrough capacitors for the filter shunt components, because feedthrough capacitors do not suffer performance degradation due to stray lead inductance. Signal line filter 86 (FIG. 6) used with the first anode signal line is a commercially available 10 KV a.c. feedthrough filter assembly having a capacitance value of 2500 pf.

Figure 7:
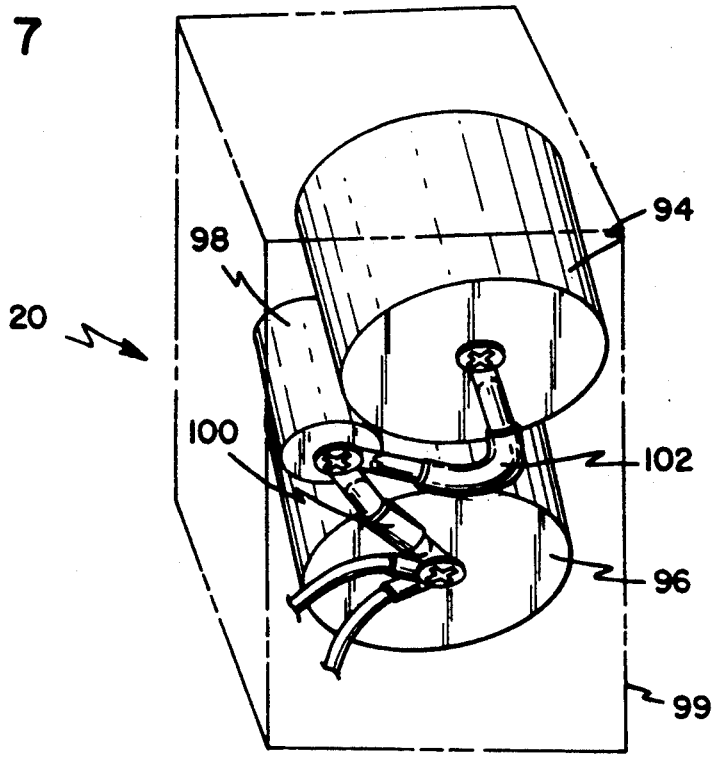
FIG. 7 is a perspective view of the second anode filter assembly of the CRT display of FIG. 1.

The use of feedthrough capacitors for the filter assembly on signal line 53 for the second anode of the color monitor is not possible because of the feedthrough capacitors limitation to 10 KV maximum working voltage ratings. Therefore, the filter assembly shown in FIG. 7 is utilized in conjunction with the signal line 53 to filter the second anode. A 30 KV second anode filter assembly 20 is connected between the high voltage rectifier 51 and the flyback transformer 58 where the signal line lead 53 is not coaxial. The second anode filter assembly shown in FIG. 7 is constructed to perform as a low inductance shunt element for the third anode lead 53 which connects to the internal CRT aquadag 28, pixel mask 32, and conductive phosphor coating 30. The filter assembly is enclosed within a protective cover insulator 99, a substantially contiguous Kydex cover. High dielectric strength silicon putty is used over the filter connections and strategic component location minimizes the possibility of arc flashover. In positioning these components physical properties such as operating temperature, separation to potential differences and atmospheric pressure were considered. The filter assembly 20, also shown FIG. 5, is placed in a small area with limited space available in the CRT secondary enclosure.

The use of RF high voltage capacitors in a parallel network results in a minimum inductance filter assembly 20. The self resonant frequency of ceramic capacitors is a function of their physical size. Therefore two different values of capacitor are utilized. The large capacitors 94 and 96 each have a capacitance value of 2700 pf, and are connected in parallel to capacitor 98 having a capacitance value of 170 pf. The large capacitors 94 and 96 provide low capacitive reactance for baseband and HF signals. The capacitor 98 has a self resonant frequency of over 100 MHz and performs its filter function effectively in the VHF/UHF frequency range. A high voltage cable is connected from high voltage rectifier 51 to capacitor 96. Second anode signal line 53 applies a potential to the aquadag 28, pixel wire mask 32, and conductive phosphor 30. The connection of the aquadag 28, pixel wire mask 32, and phosphor coating to ground via the second anode filter 20 and the secondary enclosure 12 complete the shielding conductive envelope surrounding the CRT and suppress electromagnetic emissions through the face of the CRT display without external face shielding by providing the internal conductive elements a reactive path to ground.

Figure 5:
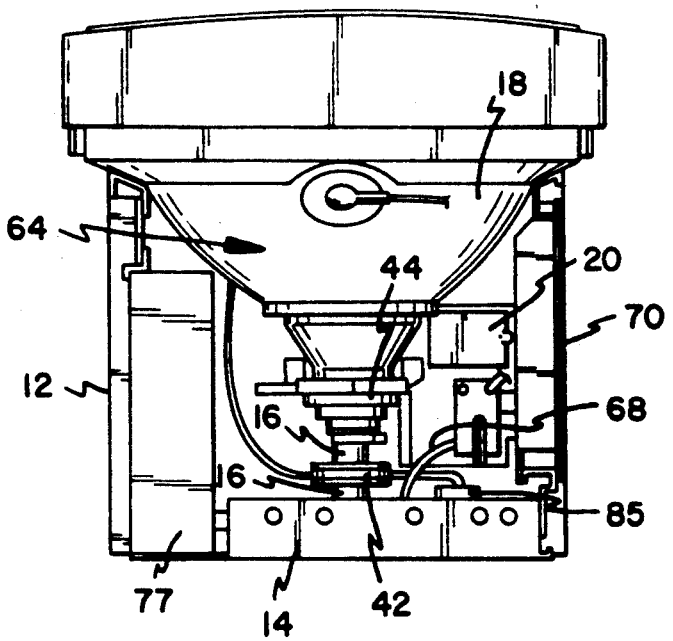
FIG. 5 is a top view of the CRT display of FIG. 1 with a top portion of the secondary enclosure cover removed to show detail.

Various cable route changes were made in the modified shielded CRT to provide effective use of space, as can be seen by the cable route change in FIG. 5 where the interface cable 64 is routed away from the CRT where unintended coupling of emanations can occur and maximizes shielding potential. In addition, deflection board ground enhancement 70, FIG. 5, provides further EMI suppression by providing a lower inductive return for decoupling capacitors installed on the deflection board. Three copper braid straps were installed between the deflection board ground track and chassis ground 34. The board is positioned along the wall of the monitor on the same side as the second anode filter 20.

It is to be understood, however, that even though numerous characteristics of the present invention have been set forth in the foregoing description, together with details of the structure and function of the invention, the disclosure is illustrative and changes in matters of order, shape, size and arrangement of the parts may be made within the principles of the invention and to the full extent indicated by the broad general meaning of the terms in which the appended claims are expressed.

What is claimed is:

1. A shielded CRT, comprising:

a CRT having a display face and an internal conductive layer associated with said display face;

means for grounding said internal conductive layer; and a shielded enclosure conductively coupled to said internal conductive layer to enclose said cathode ray tube, said display face of said CRT extending through an aperture of said shielded enclosure.

2. A shielded CRT according to claim 1 wherein said reactive grounding means comprises an anode signal line connected to said conductive layer, said anode signal line connected to ground via an anode filter for said signal line.

3. A shielded CRT according to claim 1, wherein said anode filter includes a first and second capacitance connected in parallel between said conductive layer and ground.

4. A shielded CRT according to claim 1, wherein said conductive layer includes an internal conductive aquadag, conductive mask, and conductive phosphor coating of a color CRT.

5. A shielded CRT, comprising:

a CRT having a neck portion and a non-shielded display face;

secondary shielding means for enclosing said CRT and for inhibiting electromagnetic emissions therefrom, said display face extending through an aperture of said secondary shielding means, said secondary shielding means comprising:

enclosure means for enclosing said CRT, said CRT having an internal conductive layer associated with said display face and conductively coupled to said enclosure means;

means for grounding said internal conductive layer coupled to said enclosure means; and primary shielding means internal to said secondary shielding means having at least one portion coaxial with said neck portion of said CRT for inhibiting electromagnetic emissions from said CRT, whereby electromagnetic emissions through said display face and said aperture of said secondary shielding means are reduced.

6. A shielded CRT according to claim 5 wherein said at least one portion comprises a cylindrical continuous conductor waveguide coaxial with said neck portion of said CRT.

7. A shielded CRT according to claim 6 wherein said cylindrical waveguide includes a plurality of separated longitudinal conductor fingers.

8. A shielded CRT according to claim 7 wherein said longitudinal conductor fingers are positioned within said cylindrical waveguide as a function of the position of said CRT's divergence and deflection coils.

9. A shielded CRT according to claim 6 wherein said conductor waveguide is operated below cutoff for frequencies of less than 2 Ghz to provide RF suppression.

10. A shielded CRT according to claim 5 wherein said primary shielding means further includes a shielded enclosure surrounding video circuitry connected to said CRT.

11. A shielded CRT according to claim 5, where said conductive layer comprises an internal conductive aquadag, wire mask, and phosphor coating.

12. A shielded CRT according to claim 5 further comprising a plurality of anode filters connected to signal lines of corresponding anodes of said CRT.

13. A shielded CRT according to claim 12 wherein one of said anode filters is connected to a signal line connected to said internal conductive layer of said CRT, said one of said anode filters providing said internal conductive layer with a reactive path to ground.

14. A shielded CRT according to claim 13 wherein said one of said anode filters comprises a parallel network of at least two capacitors, one of said capacitors having a capacitance of approximately 5400 pf and the other capacitor having a capacitance of approximately 170 pf, said parallel network connected between said signal line connected to said internal conductive layer and ground.

15. A shielded CRT, comprising:

a CRT;

video circuitry coupled to at least one cathode positioned in a neck portion of said CRT, said cathode ray tube further including at least two anodes, a non-shielded display face, deflection means for deflecting electrons accelerated by said anode means to said display face, and an internal conducive layer associated with said display face;

primary shielding means surrounding said video circuitry having at least one portion coaxial with said neck portion for inhibiting electromagnetic emissions therefrom; and secondary shielding means for enclosing said primary shielding means and said cathode ray tube and for inhibiting electromagnetic emission therefrom said non-shielded display face extending through an aperture in said secondary shielding means, said secondary shielding means including means for conductively coupling said internal conductive layer of said CRT to said secondary shielding means via a reactive path to ground, whereby electromagnetic emissions through said aperture of said secondary shielding means are reduced.

16. A shielded CRT according to claim 15, wherein said at least one portion of said primary shielding means comprises a cylindrical continuous conductor waveguide coaxial with said neck portion.

17. A shielded CRT according to claim 16, wherein said cylindrical waveguide includes a plurality of separated longitudinal conductor fingers.

18. A shielded CRT according to claim 17, wherein said conductor fingers are positioned in said cylindrical waveguide as a function of the position of the said CRT's divergence and deflection coils.

19. A shielded CRT according to claim 16 wherein said cylindrical waveguide includes a plurality of separated longitudinal and circumferential conductor fingers.

20. A shielded CRT according to claim 17 wherein said longitudinal and circumferential conductor fingers are positioned in said cylindrical waveguide as a function of the position of the said CRT's divergence and deflection coils.

21. A shielded CRT according to claim 16 wherein said conductor waveguide extends approximately 1½ inches beyond the position of said at least one cathode in said neck portion of said CRT.

22. A shielded CRT according to claim 16 wherein said conductor waveguide is operated below cutoff for frequencies of less than 2 Ghz to provide radio frequency suppression.

23. A shielded CRT according to claim 15 further including a plurality of anode filters, each associated with one of said at least two anodes.

24. A shielded CRT according to claim 23 wherein said one of said anode filters comprises a parallel network of at least two capacitors, one of said capacitors having a capacitance of approximately 5400 pf and the other capacitor having a capacitance of approximately 170 pf, said parallel network connected between said signal line connected to said internal conductive layer and ground.

25. A shielded CRT according to claim 23 wherein said internal conductive layer is grounded through one of said anode filters.

26. A method for shielding the RF emissions from a CRT, comprising the steps of:

providing a conductive layer internal of said CRT associated with a face portion of said CRT;

enclosing said CRT within a shielded enclosure, said face portion of said CRT extending through an aperture of said shielded enclosure;

conductively coupling said conductive layer to said shield enclosure; and grounding said conductive layer coupled to said shielded enclosure via a reactive path.

27. A method for shielding the RF emissions from a CRT having a neck portion and a conductive layer internal of said CRT associated with a face portion, comprising the steps of:

providing a waveguide coaxial with said neck portion for suppressing electromagnetic emissions therefrom;

enclosing said CRT and said waveguide within a shielded enclosure, said face portion of said CRT extending through an aperture of said shielded enclosure;

conductively coupling said conductive layer to said shielded enclosure; and grounding said conductive layer coupled to said shielded enclosure.

28. A method according to claim 27, wherein said grounding step is accomplished by providing said conductive layer with a reactive path to ground.

* * * * *